US006120421A

United States Patent [19]

Kuo

[11] Patent Number: 6,120,421

[45] Date of Patent: Sep. 19, 2000

[54] MULTIFUNCTIONAL MINIATURE EXERCISE DEVICE

[76] Inventor: Kevin Yen-Fu Kuo, 38, Flowervale Rd., Thornhill On, Canada, L3T 4J4

[21] Appl. No.: 09/058,277

[22] Filed: Apr. 10, 1998

[51] Int. Cl.[7] ..... A63B 21/008

[52] U.S. Cl. ..... 482/111; 482/121; 482/129; 482/136; 482/138

[58] Field of Search ..... 482/92, 120, 121, 482/122, 123, 114, 126, 129, 142, 133, 148, 908, 135, 136, 138

[56] References Cited

U.S. PATENT DOCUMENTS 5,839,998 11/1998 Wilkinson ..... 482/140

FOREIGN PATENT DOCUMENTS 91012854 9/1991 WIPO ..... 482/122

*Primary Examiner*—Jerome W. Donnelly
*Assistant Examiner*—Tam Nguyen
*Attorney, Agent, or Firm*—Browdy and Neimark

[57] ABSTRACT

An exercise device is composed of a bottom frame, two driving units, and two damping units. The bottom frame has a bearing seat and two frame bodies mounted on the bearing seat and provided with a placing portion. The driving units have a driving portion fastened pivotally with the frame bodies, a grip portion fastened movably with the driving portion, and a guide portion fastened with the driving portion. The damping units have a damping member fastened at one end thereof with the placing portion such that another end of the damping member is extended to the driving portion via the guide portion. The damping units further have an adjusting device fastened with the driving portion and connected with the damping member for adjusting the damping force of the damping member.

14 Claims, 5 Drawing Sheets

MULTIFUNCTIONAL MINIATURE EXERCISE DEVICE

FIELD OF THE INVENTION

The present invention relates generally to an exercise device, and more particularly to a miniature exercise device intended for use in building muscles of various parts of a human body.

BACKGROUND OF THE INVENTION

There are a variety of conventional multifunctional exercise devices available in the market place today; nevertheless these conventional exercise devices are too complicated and cumbersome in construction to be used in a small office or private home.

SUMMARY OF THE INVENTION

The primary objective of the present invention is to provide a multifunctional exercise device which is simple in construction and compact in size. The multifunctional exercise device is versatile in design in that it can be used to build the muscles of various parts of a human body.

The exercise device of the present invention consists of a bottom frame, two driving units fastened pivotally with the frame bodies of the bottom frame, a grip portion fastened with one end of the driving units, a guide portion, two damping units fastened with a placing portion of a frame body of the bottom frame, and a damping force adjusting device. The driving units are capable of swiveling in relation to the frame body when the damping force is overcome by an external force exerting on the driving units.

DETAILED DESCRIPTION OF THE INVENTION

Figure 1:
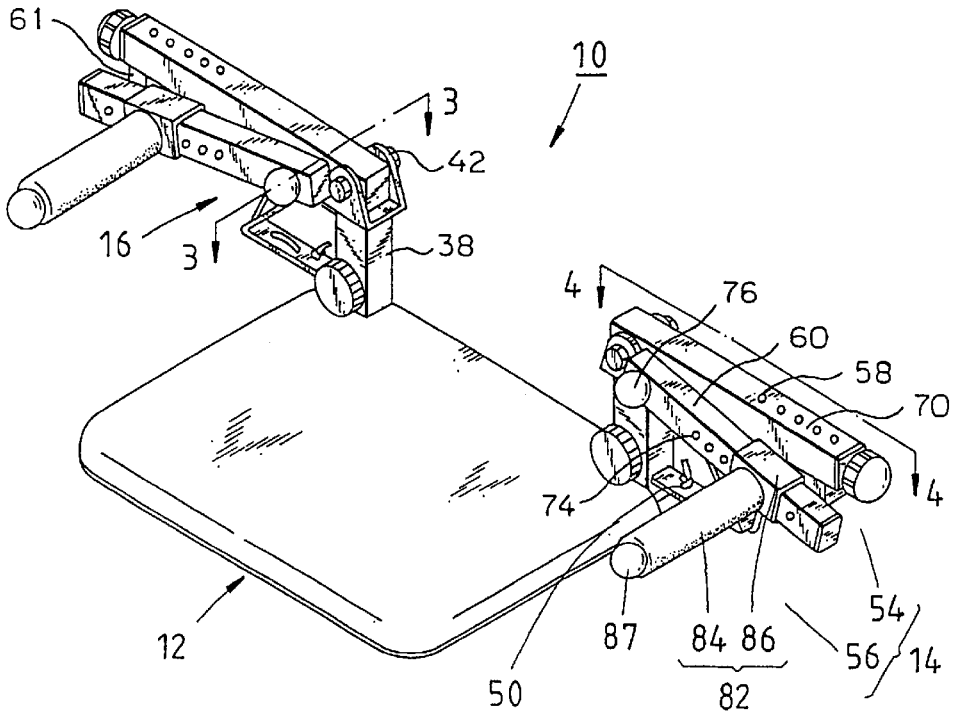
FIG. 1 shows a perspective view of the present invention.
Figure 2:
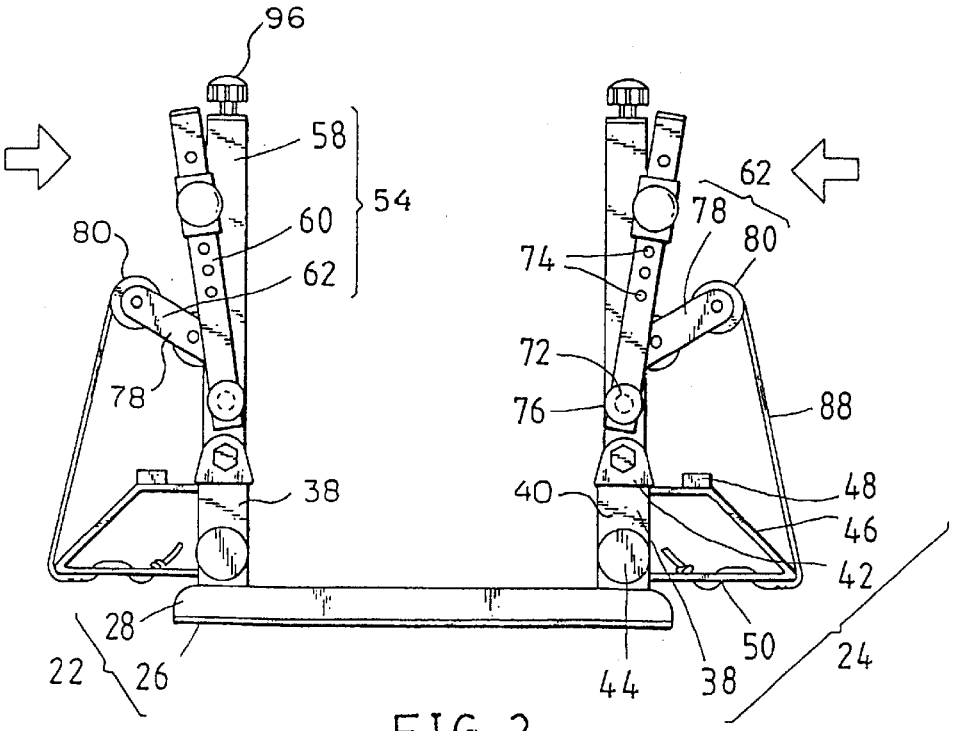
FIG. 2 shows a schematic view of the driving units of the present invention in the state of being exerted on by an external force.
Figure 3:
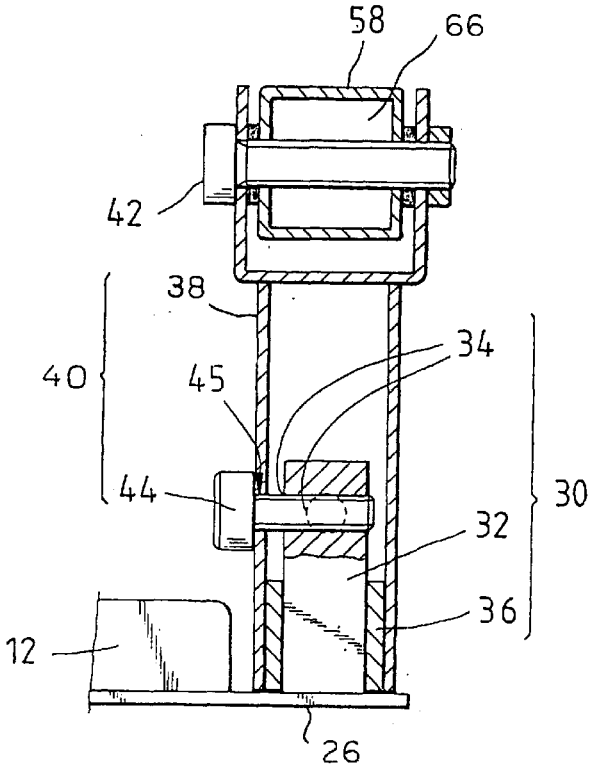
FIG. 3 shows an elevational view of a section taken along the vertical plane indicated by a line 3—3 shown in FIG. 1.
Figure 4:
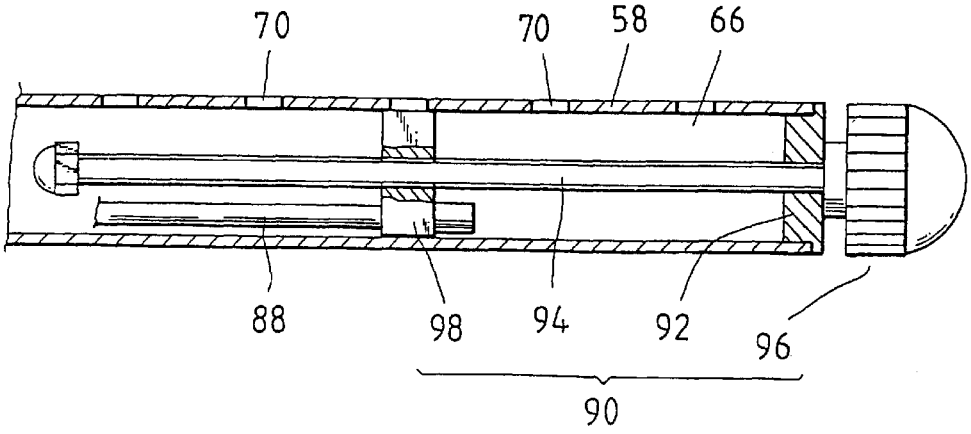
FIG. 4 shows a sectional view of a portion taken along the direction indicated by a line 4—4 as shown in FIG. 1.

As shown in FIGS. 1–4, an exercise device 10 embodied in the present invention is composed of a bottom frame 12, two driving units 14 mounted on the bottom frame 12, and two damping units 16 connecting the bottom frame 12 and the two driving units 14 for bringing about a damping effect.

The bottom frame 12 is composed of a bearing seat 22 and two frame bodies 24. The bearing seat 22 has a bottom plate 26, a pad body 28 fastened on the bottom plate 26. The bottom plate 26 is provided respectively on opposite sides thereof with a first placing portion 30. The placing portion 30 has a shaft rod 32 fastened with the bottom plate 26 by welding and provided at the top end thereof with two through holes 34 separated from each other by an angle of 90 degrees. The lower end of the shaft rod 32 is fitted into a rubber jacket 36. The frame bodies 24 are provided with a tubular base portion. A second placing portion 40 comprises said tubular base portion 38, a connection member 44, and a seat 42 located at the top of the base portion 38. The second placing portion 40 is fitted snugly over the rubber jacket 36. The connection member 44 (a bolt) is engaged with a threaded hole 45 of the base portion 38 such that the connection member 44 is extended into one of the two perpendicular through holes 34 in shaft rod 32. The base portion 38 has a bearing frame 46 and an elastic block 48 attached to the bearing frame 46. The bearing frame 46 is provided at the bottom thereof with a fastening portion 50 which is formed with three holes separated equidistantly to fasten one end of damping member 88.

The driving units 14 comprise a driving portion 54 fastened pivotally to the tubular base portion 38, and a grip portion 56 mounted on the driving portion 54. The driving portion 54 has a first rocking arm 58 fastened pivotally with the pivoting seat 42, a second rocking arm 60 fastened pivotally with the first rocking arm 58, and a guide portion 62 located at one side of the first rocking arm 58. The first rocking arm 58 is a tubular body with an open end and is provided therein with a placing space 66. The first rocking arm 58 is further provided in one side thereof with a through hole (not shown in the drawing) corresponding in location to the guide portion 62, and in another side thereof with a plurality of openings 70 opposite in location to the through hole. The first rocking arm 58 is still further provided with a retaining hole 72 opposite to the second rocking arm 60, which is provided in one side thereof with a plurality of locating holes 74 which are located along the direction of the longitudinal axis of the second rocking arm 60. A pin 76 is located at one end of the second rocking arm 60 such that the pin 76 is received in the retaining hole 72 to connect the second rocking comprises two piece bodies 78 each welded to a side of the through hole such that the piece bodies 78 are opposite to each other. The guide portion 62 further has two rotary wheels 80 fastened pivotally between the two piece bodies 78. The grip portion 56 has a hollow housing 82 with two open ends. The hollow housing 82 has a tubular portion 84, a fitting portion 86 engaging one end of the tubular portion 84, and an elastic locating pin 87 received in the tubular portion 84. The grip portion 56 is mounted on the second rocking arm 60 by means of the fitting portion 86 and the elastic locating pin 87 which is engaged with the locating hole 74 of the second rocking arm 60.

The damping units 16 have a damping member 88 and an adjusting device 90 located at the open end of the first rocking member 58. The damping member 88 is an elastic cord, which is fastened at one end thereof through the three holes in the fastening portion and with the other end thereof extending outside the bearing frame 46 to wind around the rotary wheels 80 before passing the through hole to fasten with the adjusting device 90. The adjusting device 90 has a hollow connection sleeve 92, which is engaged with the open end of the first rocking arm 58, an adjustment threaded rod 94 engaged with the connection sleeve 92, a rotating member 96 fastened with the adjustment threaded rod 94, and an adjusting block 98 engaged with the adjustment threaded rod 94 such that the adjusting block 98 is incapable of turning in the placing space 66, and that the adjusting block 98 is fastened with the damping member 88.

Figure 5:
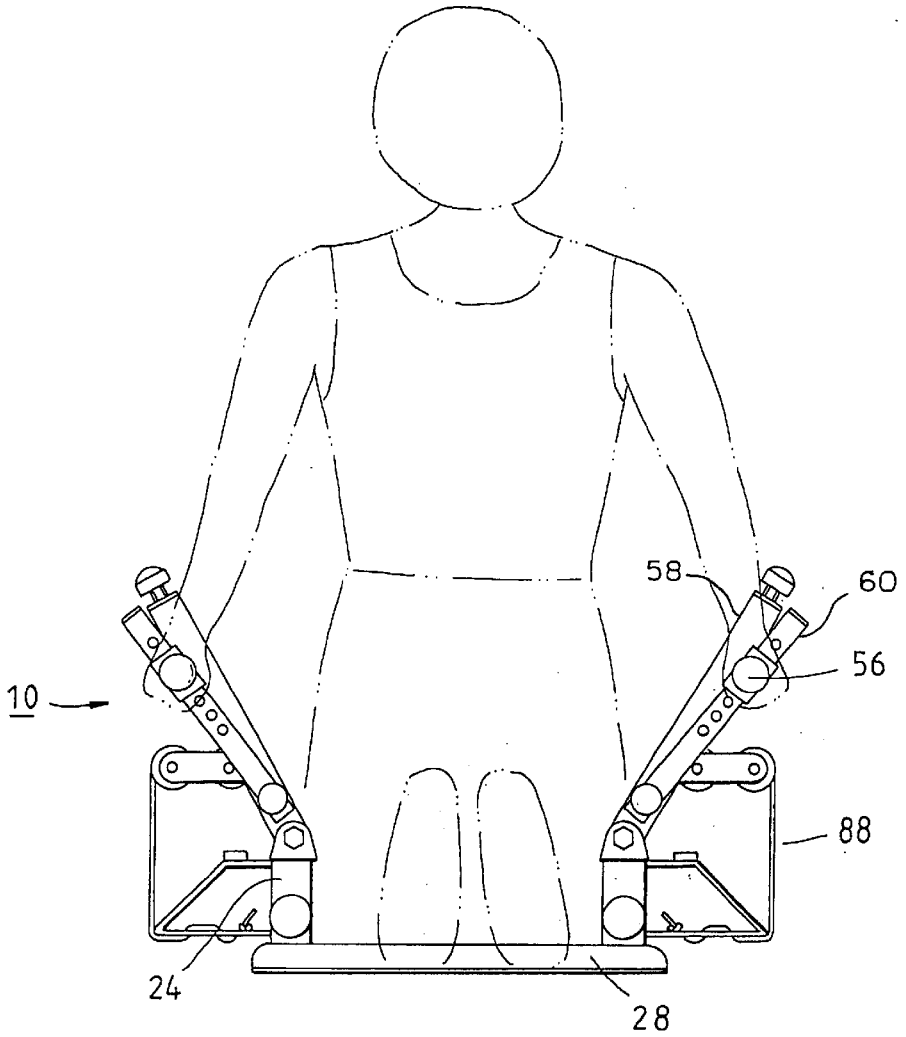
FIGS. 5–10 show schematic views of the present invention at work.

As illustrated in FIG. 5, an exerciser kneels on the bearing seat 22 such that his or her hands hold the grip portions 56, and that the driving units 14 are forced to turn inwards in a reciprocating manner for developing the muscles of his or her arms by the damping force afforded by the damping members 88.

Figure 6:
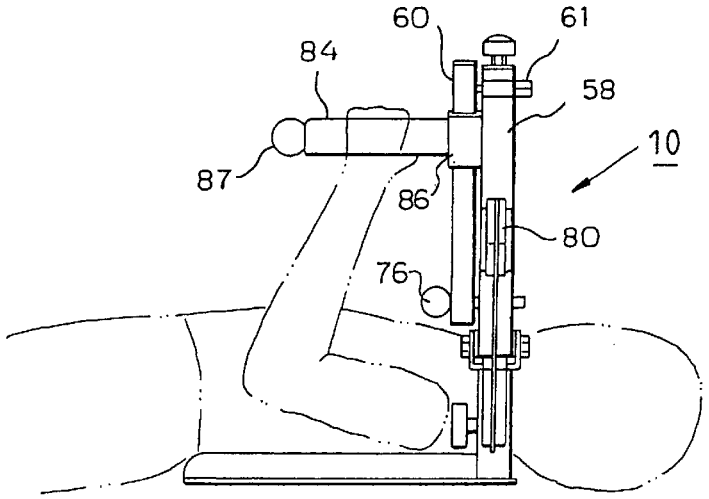
Figure 7:
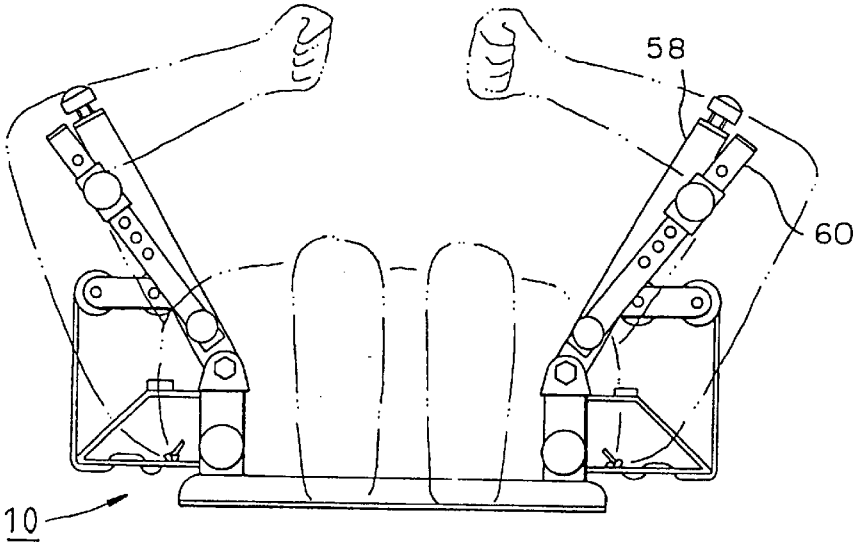
Figure 8:
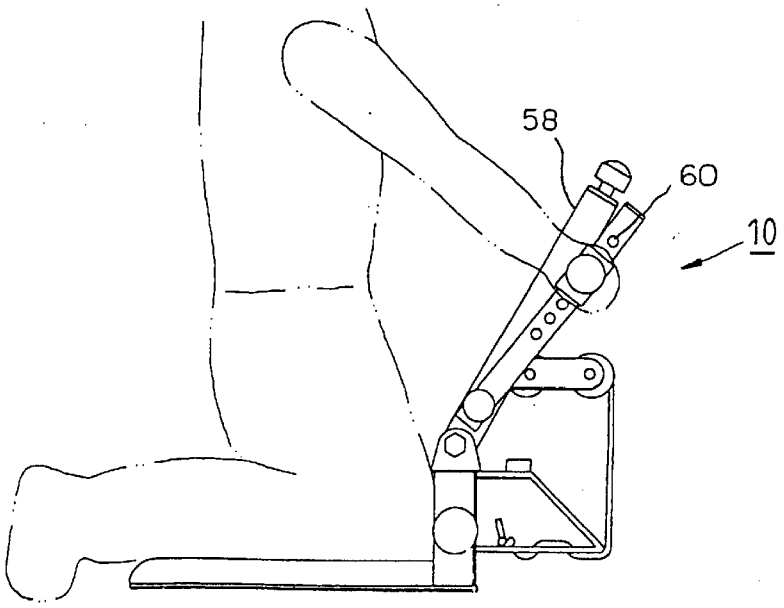
Figure 9:
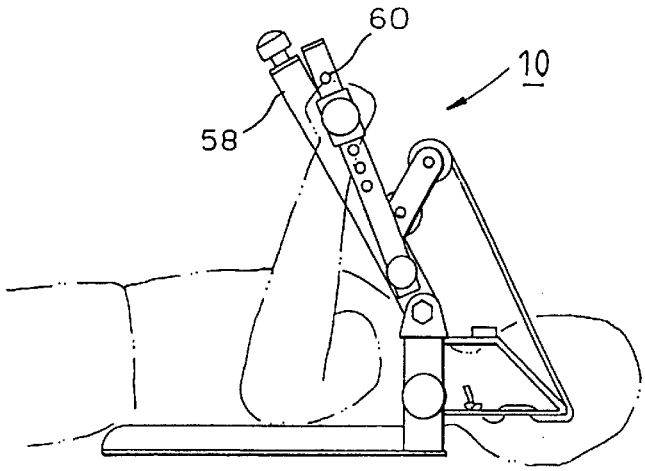
Figure 10:
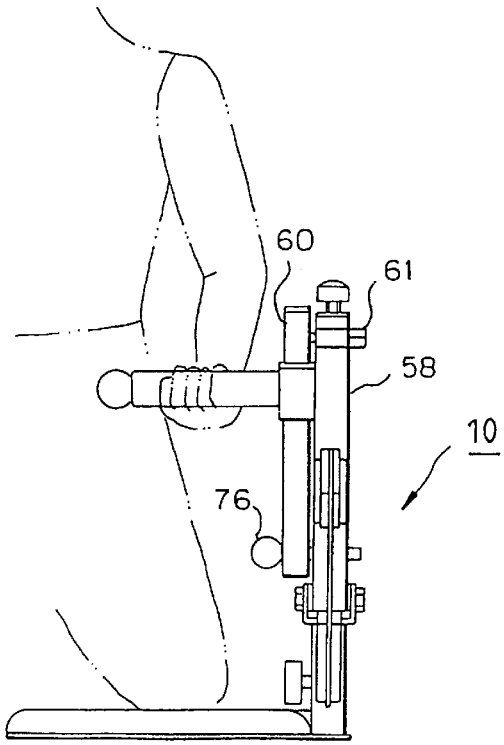

The connection members 44 may be inserted into either one of the two through holes 34 so as to enable each frame body 24 to turn 90° in relation to the bottom frame 12 to locate body 24 at different positions. The second rocking arms 60 can be caused to swivel freely. The grip portions 56 are movable. As shown in FIGS. 6 and 7, the exerciser lies on the bearing seat 22 such that his or her hands hold the grip portions 56 to drive the driving units 14 for building muscles of his or her arms, or chest, when pin 61 fixed to first rocking arm 60 engages against second rocking arm 58. As shown in FIG. 8, the exerciser kneels on the bearing seat 22 such that his or her hands hold the grip portions 56 to rotate second rocking arms 60 against second rocking arm 58 and pull the driving units 14 toward the user each other repeatedly for training his or her chest muscles. As shown in FIG. 9, after frame body 24 is rotated 90 degrees relative to the frame 12 the exerciser lies on the bearing seat 22 such that his or her hands hold the grip portions 56 to rotate arms 60 and 58 drive the driving units 14 to turn down repeatedly for training his or her arm muscles or chest muscles. As shown in FIG. 9, the exerciser lies on the bearing seat 22 such that his or her hands hold the grip portions 56 to drive the loosened second rocking arms 60 to cause the driving units 14 to turn repeatedly for building his or her chest muscles. As shown in FIG. 10, the exerciser kneels on the bearing seat 22 such that his or her hands hold the grip portions 56 to drive the loosened second rocking arms 60 to drive the driving units 14 to train his or her chest muscles. Similarly, his or her hands hold the grip portions 56 to drive the driving units 14 for training his or her arm muscles, as shown in FIG. 10.

The damping force of the damping units 16 is adjusted by turning the rotating member 98 to cause the adjusting block 90 to displace along the direction of the longitudinal axis of the adjustment threaded rod 94 so as to lengthen or shorten the overall length of the damping member 88.

What is claimed is:

1. An exercise device comprising:

a bottom frame having a bearing seat and two frame bodies mountable on said bearing seat such that said two frame bodies are opposite in location to each other, and that each of said two frame bodies are respectively provided with a first placing portion;

two driving units each having a driving portion fastened pivotally with each of said two frame bodies, a grip portion engaged on said driving portion, and a guide portion fastened with said driving portion such that said guide portion and said driving portion are located in a single plane with said second placing portion; and two damping units each having a damping member which is fastened at a first end thereof with a second placing portion, a second end of said damping member extending to said driving portion via said guide portion, each of said two damping units further having an adjusting device which is fastened with said driving portion and connected with said damping member for adjusting a damping force of said damping member;

said driving units being rotatable in relation to said frame bodies by an external force greater than the damping force of said damping member;

wherein said frame bodies each have a second placing portion, each of the two first placing portions permitting fixed mounting of the second placing portion of a frame body of the two frame bodies in at least two different positions on a mounting surface of the bearing seat;

wherein in a first position of the two positions, the driving units are rotatable in a single plane, and in a second position of said two positions, the driving units are rotatable in parallel planes, wherein, each of said first placing portion being respectively fixed to the corresponding second placing portion by a removeable connection member extending through the second placing portion into a shaft rod of each of the two first placing portions.

2. The exercise device as defined in claim 1, wherein said bearing seat has a bottom plate, and a pad mounted on said bottom plate.

3. The exercise device as defined in claim 1, wherein said shaft rod has a plurality of through holes, a rubber jacket fitted over said shaft rod; wherein said second placing portion is tubular in construction and provided respectively with a threaded hole; and wherein said removeable connection member is a bolt, which is respectively engaged with either of said threaded holes and extend into said through holes of said shaft rod.

4. The exercise device as defined in claim 1, wherein each of said second placing portions of said frame bodies has a bearing frame, an elastic block fastened with said bearing frame such that said elastic block is spaced apart from one side of said driving portion, and a fastening portion having holes on said bearing frame such that said damping member can be affixed to the fastening portion.

5. The exercise device as defined in claim 1, wherein said driving portion has a first rocking arm fastened pivotally with said frame body, a second rocking arm fastened pivotally with said first rocking arm; wherein said grip portion is removeably fastened with said second rocking arm; and wherein said adjusting device is fastened with a first end of said first rocking arm, and said second rocking arm is pivotally fastened proximate to a second end of said first rocking arm.

6. The exercise device as defined in claim 5, wherein said second rocking arm is provided along the direction of a longitudinal axis thereof with a plurality of locating holes; wherein said grip portion has a housing having therein an elastic locating device respectively engageable with said locating holes of said second rocking arm to permit selective positioning of said grip portion on said second rocking arm.

7. The exercise device as defined in claim 5, wherein said first rocking arm is provided with a receiving space having an open end, and a through hole in communication with said receiving space; wherein said guide portion is located corresponding to said through hole; wherein said adjusting device is located at said open end of said receiving space; and wherein said damping members are elastic cords extending into said receiving space via said through hole.

8. The exercise device as defined in claim 7, wherein said adjusting device comprises a connection sleeve engaged with said open end of said receiving space, an adjustment threaded rod fitted into said connection sleeve, a rotating member fastened with one end of said adjustement threaded rod, and an adjusting block fastened with said adjustment threaded rod such that said adjusting block is retained in said receiving space, and that said adjusting block is fastened with said damping member.

9. The exercise device as defined in claim 7, wherein said guide portion has a two piece body located at said through hole such that said two piece body is corresponding in location to said through hole, each of said guide portion respectively having at least one rotary wheel fastened pivotally between said two piece; and wherein said elastic cords are wound on said rotary wheel.

10. An exercise device comprising:

a bottom frame having a bearing seat and two frame bodies mounted on said bearing seat such that said two frame bodies are opposite in location to each other, and that said two frame bodies are provided respectively with a first placing portion;

two driving units each having a driving portion fastened pivotally with said frame bodies, a grip portion fastened with said driving portion, and a guide fastened with said driving portion such that said guide portion is coplanar to said first placing portion; and two damping units each having a damping member which is fastened at one end thereof with said first placing portion such that another end of said damping member is extended to said driving portion via said guide portion, each of said two damping units further having an adjusting device which is fastened with said driving portion and connected with said damping member for adjusting a damping force of said damping member;

said driving units capable of being driven to swivel in relation to said frame bodies by an external force greater than the damping force of said damping member;

wherein each first placing portion of said frame bodies has a bearing frame, an elastic block fastened with said bearing frame such that said elastic block is spaced apart from one side of said driving portion, and a fastening portion having holes on said bearing frame such that said damping member can be affixed to the fastening portion.

11. An exercise device comprising:

a bottom frame having a bearing seat and two frame bodies mounted on said bearing seat such that said two frame bodies are opposite in location to each other, and that said two frame bodies are provided respectively with a first placing portion;

two driving units each having a driving portion fastened pivotally with said frame bodies, a grip portion fastened with said driving portion, and a guide fastened with said driving portion such that said guide portion is coplanar to said first placing portion; and two damping units each having a damping member which is fastened at one end thereof with said placing portion such that another end of said damping member is extended to said driving portion via said guide portion, each of said two damping units further having an adjusting device which is fastened with said driving portion and connected with said damping member for adjusting a damping force of said damping member;

said driving units capable of being driven to swivel in relation to said frame bodies by an external force greater than the damping force of said damping member;

wherein said driving portion has a first rocking arm fastened pivotally with said frame body, a second rocking arm fastened pivotally with said first rocking arm; wherein said grip portion is removeably fastened with said second rocking arm; and wherein said adjusting device is fastened with a first end of said first rocking arm, and said second rocking arm is pivotally fastened proximate to a second end of said first rocking arm;

wherein said second rocking arm is provided along the direction of a longitudinal axis thereof with a plurality of locating holes; wherein said grip portion has a housing having therein an elastic locating device respectively engageable with said locating holes of said second rocking arm to permit selective positioning of said grip portion on said second rocking arm.

12. The exercise device as defined in claim 11, wherein said first rocking arm is provided with a receiving space having an open end, and a through hole in communication with said receiving space; wherein said guide portion is located corresponding to said through hole; wherein said adjusting device is located at said open end of said receiving space; and wherein said damping members are elastic cords extending into said receiving space via said through hole.

13. The exercise device as defined in claim 12, wherein said adjusting device comprises a connection sleeve engaged with said open end of said receiving space, an adjustment threaded rod fitted into said connection sleeve, a rotating member fastened with one end of said adjustment threaded rod, and an adjusting block fastened with said adjustment threaded rod such that said adjusting block is retained in said receiving space, and that said adjusting block is fastened with said damping member.

14. The exercise device as defined in claim 12, wherein said guide portion has two piece bodies located at said through hole such that said two piece bodies are opposite in location to each other, each of said guide portion respectively having at least one rotary wheel fastened pivotally between said two piece bodies; and wherein said elastic cords are wound on said rotary wheel.

* * * * *